United States Patent [19]

McCarthy et al.

[11] 4,373,145

[45] Feb. 8, 1983

[54] THIN FILM ELECTROLUMINESCENT DEVICE

[75] Inventors: Shaun L. McCarthy, Ann Arbor; John J. Lambe, Birmingham, both of Mich.

[73] Assignee: Ford Motor Company, Dearborn, Mich.

[21] Appl. No.: 242,966

[22] Filed: Mar. 12, 1981

Related U.S. Application Data

[62] Division of Ser. No. 49,855, Jun. 18, 1979, abandoned.

[51] Int. Cl.[3] ..... H01J 1/63; H01J 1/70

[52] U.S. Cl. ..... 313/503; 313/506

[58] Field of Search ..... 313/498, 503, 506

[56] References Cited

U.S. PATENT DOCUMENTS

| | | | |
|---|---|---|---|
| 2,924,732 | 2/1960 | Lehmann | 313/506 |
| 3,149,281 | 9/1964 | Lieb | 324/96 |
| 3,295,002 | 12/1966 | Amans | 313/503 |
| 3,449,260 | 6/1969 | Janssens et al. | 252/301.6 |
| 3,760,216 | 9/1973 | Lasser et al. | 313/94 |
| 3,919,589 | 11/1975 | Hanak | 313/506 X |
| 4,027,192 | 5/1977 | Hanak | 313/498 |

OTHER PUBLICATIONS

Kroger, "Some Aspects of the Luminescence of Solids," Elsevier Publishing Co.; New York; 1948; pp. 60, 290–294 and 297 cited.

*Primary Examiner*—Robert Segal

*Attorney, Agent, or Firm*—Paul K. Godwin, Jr.; Clifford L. Sadler

[57] ABSTRACT

A thin film electroluminescent device constructed on a smooth surface substrate on which a base conductive layer is formed, followed in sequence by an impurity doped barrier layer, an electrically resistive layer and a counterelectrode layer. The impurity doped barrier layer is doped with a material which exhibits electroluminescence.

The impurity doped barrier layer is produced in a controlled oxidation process of the base conductive layer which is alloyed to a minor extent with the impurity material.

3 Claims, 1 Drawing Figure

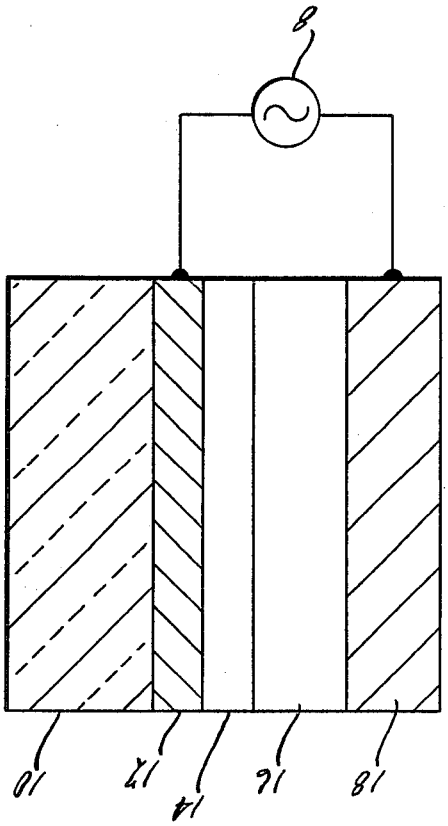
10
12
14
16
18
8

THIN FILM ELECTROLUMINESCENT DEVICE

This application is a divisional of Ser. No. 49,855 filed June 18, 1979, now abandoned.

BACKGROUND OF THE INVENTION

1. Field of the Invention

The present invention is directed to the area of solid state light sources and more specifically to an improved thin film electroluminescent device which, through appropriate selection of materials, may be constructed to generate a number of different colors.

2. Description of the Prior Art

It has long been recognized that thin film, solid state, light emitting devices have great potential for replacing conventional vacuum fluorescent and other plasma type display devices. However, conventional solid state electroluminescent devices have required quite complicated and exact composition preparation for the electroluminescent material and have often been plagued by problems such as short life time and low light level emissions.

SUMMARY OF THE INVENTION

It is intended by the present invention to improve devices of the prior art by providing an electroluminescent device which is easily constructed at relatively low cost, while at the same time having high reliability operation with colored light emissions that are predictable and consistent.

The present invention is constructed on a smooth surfaced substrate where a base conductive layer is formed followed in sequence by a unique impurity doped barrier layer, an electrically resistive layer and a counterelectrode layer. The impurity doped barrier layer is doped with a material which exhibits electroluminescence and is connected from elements such as manganese and several of the rare earth elements. At room temperature, an alternating voltage is applied between the base conductive layer and the counterelectrode layer. The applied voltage field causes the impurity doped barrier layer to luminesce and emit visible radiation of a characteristic color. The resistive layer acts as a ballast resistor to prevent ion conduction from the counterelectrode layer.

The production of the impurity doped barrier layer is also unique in that it is a controlled oxidation (anodization) process of the base conductive layer which is alloyed to a minor extent with the impurity material. In the oxidation process, the base conductive layer is submerged in a phosphate electrolyte and is employed as an anodic electrode. A cathodic electrode is also submerged in the phosphate electrolyte and a constant current is generated in the phosphate electrolyte between the two electrodes. The voltage between the electrodes is monitored to insure that the increase therein occurs at a constant rate as the current is kept constant. At a predetermined voltage, in the linear range of increase, the current flow is terminated and the oxidized base conductive layer is removed from the electrolyte. The result is the growth of a nonporous impurity doped oxidation barrier layer which is weakly conducting and functions as an electroluminescent material.

Many elements have been found that can be employed as the impurity doped material in the insulative layer. Elements such as manganese, praseodymium, neodymium, europium, terbium, dysprosium, holmium and erbium have been found to function in this structure and exhibit luminescence in the color ranges for which they are conventionally employed as electron excited phosphors.

The ballast resistive layer was found to be necessary in the present invention when the device operated in room temperature since it limits the transient currents associated with breakdown in the device and thereby provides extended operating life to the device. However, when the device is intended for low temperature operations, the ballast resistive layer may be eliminated and the voltage source may employ longer switching cycles without damage. For instance, at liquid nitrogen cooling temperatures, the device will emit light without a ballast resistive layer and with D.C. voltage applied across the electrodes.

DESCRIPTION OF THE PREFERRED EMBODIMENT

The illustrated configuration is an example of those which have been similarly constructed and have been found to emit visible light, operate at low voltages, and have a relatively long life.

A substrate 10 having a smooth surface is coated with a base electrode 12, which, in this case, is an aluminum layer alloyed to a minor extent with an impurity such as manganese. A barrier layer 14 is formed on the base electrode 12 by an anodization technique described hereinbelow which results in an aluminum oxide layer doped with impurity ions of the alloyed material. In this example, the oxide barrier layer 14 contains the impurity ion of manganese. As a result of the particular anodization process, the impurity doped barrier layer 14 is a nonporous structure which is also uniform in thickness. A film of electrically resistive materials, in this case manganese oxide, is deposited over the insulative barrier layer 14 to a thickness of several thousand angstroms and serves as a ballast resistor 16 to limit transient currents and thereby extend the life of the device. Of course, it is important that the electrically resistive material be substantially transparent to allow emitted light to pass through from the underlying insulative layer 14. A counterelectrode 18 is a thin semi-transparent metal film of gold or aluminum evaporated to a thickness of approximately 100 angstroms and is electrically connected to one side of an A.C. power source 8.

The other side of the voltage source 8 is connected to the base electrode 12 to provide an alternating field across the insulative layer 14 and the resistive layer 16 to activate the device. During room temperature operation, the A.C. voltage source 8 operates at approximately 1 KHz and has a voltage output of approximately 60 volts rms. The transport current at this voltage is approximately 1 ma.

The example of the present invention described herein employes manganese as the impurity doped material for the insulative barrier layer 14. That example of the device exhibits electroluminescence when activated by the alternating field generated between the electrodes 12 and 18 and emits a yellow-orange light having an intensity of approximately 30 ft.-lamberts.

While the above structure is illustrative of the preferred embodiment, known at this time, it has been found that other impurity doped materials may also be employed in the barrier layer so that the resultant device will emit light having color properties characteristic of the particular dopant material. Other impurity materials which have been found to be compatible with this structure and their characteristic color emissions are: praseodymium-bluish-green; neodymium-pink; terbium-green; dysprosium-reddish; holmium-greenish; and erbium-orange.

We have found that a simple, reliable method of producing the impurity doped barrier layer 14 may be accomplished by initially producing a base conductive layer of a material such as aluminum alloyed to a minor extent with the impurity dopant material selected for the barrier layer. The formation of the base conductive layer 12 onto the smooth surface of the substrate 10 is performed either by evaporating an aluminum alloy source material or by co-evaporation of individual sources of aluminum and the selected impurity dopant material. Generally, the alloy formed on the substrate surface contains less than 5% of the impurity dopant material. Over concentration of the impurity material may result in concentration quenching.

The formed base conductive layer is oxidized to form an impurity-doped, nonporous barrier layer of aluminum oxide. In order to form the nonporous barrier layer, the base conductive film is submerged in an electrolyte of dilute phosphoric acid and is connected as an anode electrode in the electrolyte. The cathodic electrode is also submerged in the electrolyte. The two electrodes are then connected to a constant current source and an anodizing current density of 50 ma/cm$^2$ is maintained until a voltage of approximately 100 volts is monitored across the anodization cell electrodes.

It has been found that the barrier layer increases in thickness continuously over the surface of the base electrode layer for a period of time. The monitored voltage from the constant current source increases in a linear fashion while the barrier layer is being formed as a nonporous structure at a rate of approximately 10 A/volt. When the voltage increase rate changes, it has been found that such a nonlinear voltage increase is due to a porous growth structure of the barrier layer. Therefore, in order to produce a nonporous barrier layer structure, we have chosen to terminate the constant current through the anodization cell while the voltage is increasing at a constant rate in the linear range. In this example, 100 volts is within the linear range of increase and the formed barrier layer has a nonporous structure of approximately 1000A. The substrate containing the base conductive layer and the newly formed impurity doped barrier layer of aluminum oxide is removed from the electrolyte and prepared for the formation of the electrically resistive film thereover.

We have found that a resistive film deposited over the barrier layer acts as a ballast resistor to limit transient currents and thereby extend the life of the device for operation in temperatures in the range of room temperature. The electrically resistive film is evaporated over the impurity doped barrier layer to a thickness of approximately 500–1000 A. Several materials have been tested and shown to be suitable for this device. In common, they must have high sheet resistance to prevent lateral electron current flow, while at the same time allow a small amount of current to flow through the layer and prevent high transient current flow that may cause insulator breakdown and burnout of the device. In addition, the electrically resistive materials selected must be semi-transparent in order to allow light emitted from the impurity doped barrier layer to escape from the device through the resistive layer. Manganese oxide, molybdenum oxide, cerium floride, tungsten oxide, and magnesium flouride have each been employed and have been found to be suitable for use as an electrically resistive film material in the present invention.

In obtaining the electrically resistive layer 16 for the illustrated embodiment of the present invention, a manganese oxide layer was produced by evaporating manganese in a partial pressure of oxygen at approximately $4\times10^{-4}$ torr. An alternative method of obtaining the resistive layer is to evaporate the manganese metal in a vacuum and then place the sample in an atmospheric oven at 450° C. for a period of time sufficient to produce the metal oxide layer.

A counterelectrode 18 is sufficiently thin so as to be semi-transparent and may be formed of gold or aluminum evaporated to a thickness of around 100 A, or of a conducting oxide of tin deposited to a thickness of 500 A . At this time, the oxide of tin material is preferred as the counterelectrode 18 since it has been found to offer resistance to ion migration while at the same time contain the necessary attributes of a counterelectrode and remain semitransparent so as to allow emitted light to escape from the underlying barrier layer.

In operation, the electroluminescent device of the present invention operates to emit approximately 30 ft. lamberts when an A.C. voltage of approximately 60 volts rms at a frequency of 1 kc is applied between the base electrode 12 and the counterelectrode 18. The device is polarity sensitive and functions as a diode (i.e., light emission occurs when the aluminum base electrode 12 is connected as the cathode and the counterelectrode 18 is connected as the anode).

At low temperature operation, it has been found that the device of the present invention may be operated at D.C. potentials of approximately 50–60 volts with equal intensity of light emission.

it will be apparent that many modifications and variations may be effected without departing from the scope of the novel concept of this invention. Therefore, it is intended by the appended claims to cover all such modifications and variations which fall within the true spirit and scope of the invention.

We claim:

1. An electroluminescent device which emits visible radiation in response to an applied voltage comprising:

a support substrate having a first surface;

a base conductor film of doped aluminum overlaying said substrate surface;

an electroluminescent barrier layer of impurity doped aluminum oxide overlaying said base conductor film;

a semi-transparent electrically resistive layer overlaying said barrier layer;

a relatively transparent counterelectrode overlaying said resistive layer, wherein said device emits visible radiation when said voltage is applied between said base conductor and said counterelectrode, and further wherein said barrier layer of aluminum oxide contains ions of said impurity;

said device being formed by a method including the following steps:

depositing aluminum alloyed, to a minor extent, with an impurity selected from the group consisting of manganese, praseodymium, neodymium, europium, terbium, dysprosium, holmium and erbium to form said base conductor film;

oxidizing said conductor film to form a nonporous layer doped with said impurity and defining said barrier layer;

depositing a layer of electrically resistive material selected from the group consisting of manganese oxide, molybdenum oxide, cerium fluoride, tungsten oxide, and magnesium fluoride on said nonporous barrier layer;

and depositing a semi-transparent metal film on said resistive layer to define said counterelectrode.

2. An electroluminescent device as in claim 1, wherein said oxidizing step is performed by submerging said substrate containing said conducting metal in an electrolyte bath and generating a constant current between a submerged cathodic electrode and said conducting layer, monitoring the voltage increase between said cathodic electrode and said conducting layer, and terminating said constant current at a predetermined time prior to the formation of a porous oxidation layer.

3. An electroluminescent device as in claim 2, wherein said electrolyte bath is dilute phosphoric acid, said constant current is approximately 50 ma/cm$^2$ between said cathodic electrode and said conductor layer, and said constant current is terminated when said monitored voltage increases to approximately 100 volts.

* * * * *